US005613553A

United States Patent [19]

Hong

[11] Patent Number: 5,613,553

[45] Date of Patent: Mar. 25, 1997

[54] STACKET-UP TYPE HEAT EXCHANGER FOR A GAS BOILER

[75] Inventor: Woong-Sub Hong, Incheon, Rep. of Korea

[73] Assignee: Daewoo Electronics Co., Ltd., Seoul, Rep. of Korea

[21] Appl. No.: 579,428

[22] Filed: Dec. 27, 1995

[30] Foreign Application Priority Data

Dec. 27, 1994 [KR] Rep. of Korea ..... 94-37366

[51] Int. Cl.[6] ..... F28D 9/00

[52] U.S. Cl. ..... 165/140; 165/167; 122/209.1; 122/367.1

[58] Field of Search ..... 122/209.1, 214, 122/215, 219, 220, 367.1; 165/154, 164–167, 140

[56] References Cited

U.S. PATENT DOCUMENTS

| | | | |
|---|---|---|---|
| 1,593,844 | 7/1926 | Nygaard | 122/214 X |
| 1,669,062 | 5/1928 | Menzel | 165/167 |
| 2,138,091 | 11/1938 | Cortines | 165/167 X |
| 2,281,154 | 4/1942 | Hromadko | 165/140 |
| 4,423,771 | 1/1984 | Frederick | 165/151 |

FOREIGN PATENT DOCUMENTS

| | | |
|---|---|---|
| 0404259 | 12/1990 | European Pat. Off. . |
| 1520664 | 8/1968 | France . |
| 2638822 | 5/1990 | France . |

*Primary Examiner*—Allen J. Flanigan
*Attorney, Agent, or Firm*—Fish & Richardson, P.C.

[57] ABSTRACT

As a heat exchanger for a hot-water storage type gas boiler, the present invention provides an easily assembled stacked-up type heat exchanger eliminating the installation of a separate hot-water pipe so that the thermal efficiency of the heat exchanger can be improved and the size thereof can be reduced. The stacked-up type heat exchanger comprises a bottom plate including one or more combustion gas flues for carrying combustion gas from a burner, a return heating-water outlet for collecting and delivering heating-water, and a cold-water inlet; a first plate disposed over the bottom-plate; fourth plate disposed over the first plate; and a top plate disposed over the fourth plate.

7 Claims, 4 Drawing Sheets

STACKET-UP TYPE HEAT EXCHANGER FOR A GAS BOILER

BACKGROUND OF THE INVENTION

1. Field of the Invention

The present invention relates to a heat exchanger for a gas boiler, and more particularly to a stacked-up type heat exchanger for a gas boiler wherein a plurality of plates are stacked up to construct a combustion gas flue for carrying exhaust gas, a hot/cold-water tube for supplying cold-water and for heating the same, and a return heating-water inlet for supplying heating-water.

2. Description of the Prior Art

In a conventional hot-water storage type gas boiler, a heat exchanger comprises a cylinder with a plurality of pipes therein to carry fresh water from the lower portion to the upper portion, a heating-water outlet and a return heating-water inlet disposed at the upper portion and the lower portion of the cylinder respectively, and a burner therebeneath for heating water. U.S. Pat. Nos. 4,432,307 and 4,644,904 disclosed heat exchangers used in such a hot-water storage type gas boiler.

FIG. 1 is a front sectional view for showing one of the embodiments of such a conventional heat exchanger for a hot-water storage type gas boiler as mentioned above.

According to FIG. 1, a heat exchanger 1 includes a heating-water heating portion 3 for heating and storing heating-water and a hot-water pipe 4. Inside heating-water heating portion 3 a plurality of flues 2 vertically passing through heating-water heating portion 3 are provided to carry high temperature exhaust gas. At an upper portion of the outer wall of heating-water heating portion 3 a heating-water outlet 31 for delivering high temperature heating-water is provided and a return heating-water inlet 30 is disposed at the lower portion thereof.

Hot-water pipe 4 made in a helical hot water pipe is disposed around the inner periphery of heating-water heating portion 3 to thereby make a heat exchange between hot/cold-water and heating-water. Hot-water pipe 4 also includes a cold-water inlet 40 and a hot-water outlet 41 at the lower and upper portions of heat exchanger 1 respectively so that hot/cold-water can come in and out heating-water heating portion 3. At cold-water inlet 40 a supplementary water valve 9 is provided for supplying heating-water with supplementary water.

At the lower portion of heat exchanger 1, a gas supply pipe 7 and a manifold 8 for jetting supplied fuel through gas supply pipe 7 to combustion points. In addition, a baffle, not shown in FIG. 1, is provided inside flue 2 to delay the flow of exhaust gas so that more heat is transferred to heating-water. An exhaust hood 6 is mounted on heat exchanger 1 to suck the exhaust gas risen through flue 2.

According to the heat exchanger for a boiler constructed as above, an high temperature exhaust gas is generated by burning the gas blown from manifold 8. The exhaust gas enters into flue 2 through a bottom surface of heat exchanger 1. At this time, the exhaust gas rising up through flue 2 exchanges heat with heating-water by way of the wall of flue 2. As such, the temperature of heating-water increases and hot-water pipe 4 located within in the heating-water is also affected by the heat.

Cold-water entering into heat exchanger 1 through cold-water inlet 40 is affected by the heat while passing through hot-water pipe 4 and thereafter high temperature water is delivered out of heat exchanger 1 through hot-water outlet 41. Exhaust gas that has passed through flue 2 is concentrated at exhaust hood 6 and is exhausted out of a boiler.

However, according to the conventional heat exchanger for a hot-water storage type gas boiler constructed as above, since flue 2 and separate hot-water pipe 4 are installed in heat exchanger 1, the welding process in manufacturing the heat exchanger is very difficult and the manufacturing time is prolonged accordingly. Also, in order to increase the thermal efficiency in such a heat exchanger, a larger-sized heat exchanger is required, accordingly high manufacturing cost and low productivity can not be avoided.

SUMMARY OF THE INVENTION

It is one object of the present invention for overcoming the difficiency described in the foregoing to provide a stacked-up type heat exchanger for a gas boiler eliminating such a separately welded hot-water pipe.

Another object of the present invention is to provide a stacked-up type heat exchanger for a gas boiler wherein the thermal efficiency of a heat exchanger is improved so that a smaller heat exchanger than the conventional one can be obtained.

The third object of the present invention is to provide a stacked-up type heat exchanger for a gas boiler wherein a plurality of plates are stacked up in a repeated and easy manner so that cost-effective manufacturing can be achieved.

The objects of the present invention are achieved by providing a stacked-up type heat exchanger for a gas boiler comprising a bottom plate, a first plate, a fourth plate and a top plate wherein:

the bottom plate includes one or more combustion gas flue(s) for carrying exhaust gas burned in a burner, a return heating-water outlet for concentrating heating-water and expelling it, and a cold-water inlet for delivering cold-water; the first plate includes a combustion gas flue communicating with the combustion gas flue of the bottom plate, one or more heating-water inlet(s) for delivering heating-water, annular cavity which faces downward, is concave in cross-section and which forms a ring-type pipe by fitting together with a fourth plate illustrated below, and a cold-water supply pipe, one end of the cold-water supply pipe being connected to the cold-water inlet and the other end of the cold-water supply pipe communicating with a lower part of a curved portion formed by the necked portions; the fourth plate includes a combustion gas flue communicating with the combustion gas flue of the first plate, one or more heating-water inlet(s) for carrying heating-water, annular cavity which faces upward, is concave in cross-section and which forms a ring-type pipe by fitting together with the annular cavity of the first plate, a hot-water delivery pipe disposed at an upper part of a curved portion formed by the annular cavity and communicating with a hot/cold-water flowing tube formed by the annular cavity being fitted together with each other; and the top plate includes a combustion gas flue communicating with the combustion gas flue of the fourth plate, a return heating-water inlet for delivering return heating-water into a heat exchanger, and a hot-water outlet connected with the hot-water delivery pipe.

At this time, it would be possible between the first plate and the fourth plate to reciprocally stack up a second plate including a combustion gas flue communicating with the combustion gas flue of the first plate, one or more heating-water inlets for carrying heating-water, annular cavity which faces upward, is concave in cross-section and which forms a ring-type pipe by fitting together with those of the first plate, and a hot-water delivery pipe provided at an upper part of a curved portion formed by the annular cavity and for delivering hot/cold-water inside the hot/cold-water flowing tube; and a third plate having the same structure as the first plate.

Between the bottom plate and the top plate, two or more combined sets of the first, second, third and fourth plates can also be stacked up.

It is preferable that at the end of each of the combustion gas flues, a baffle for delaying the flow of exhaust gas is provided.

Also, the return heating-water outlet of the bottom plate can serve as a return heating-water inlet and the return heating-water inlet of the top plate, as a return heating-water outlet. Likewise, the cold-water inlet of the bottom plate and the hot-water outlet of the top plate can change their roles.

According to the stacked-up type heat exchanger for a gas boiler constructed as above, high temperature exhaust gas is carried through the combustion gas flue, cold-water enters and hot-water is delivered through the hot/cold-water flowing tube, and heating-water for heating a room enters into a heat exchanger through the return heating-water inlet and goes out through the return heating-water outlet after a heat exchange.

The exhaust gas is entered through the combustion gas flue of the bottom plate, makes a heat exchange while passing through the combustion gas flue of each of the mid plates and is finally delivered through the combustion gas flue of the top plate.

Hot/cold-water flows in the following way to make a supply of hot-water. Cold-water supplied by the cold-water inlet of the bottom plate enters into the hot/cold-water flowing tube via the cold-water supply pipe and flows along the annular-shaped pipe. The hot/cold-water is delivered to the next hot/cold-water flowing tube through another cold-water supply pipe while make a heat exchange. The hot/cold-water water that has passed through several hot/cold-water flowing tubes in such a manner attains higher temperature to make hot-water. The hot-water is delivered to the hot-water outlet via the hot-water delivery pipe.

Returning heating-water is entered into a heat exchanger through the return heating-water inlet of the top plate and makes a heat exchange while flowing around the combustion gas flue. The heating-water between the top plate and the fourth plate is delivered to a space formed by the fourth plate and the third plate through the heating-water inlet. That is to say, while heating-water flows downwardly, the heat exchange is made and the heating-water that has reached the bottom plate is delivered out of the heat exchanger through the return heating-water outlet.

Therefore, according to the present invention described in the foregoing, a separate hot-water pipe is not installed in a heat exchanger by a hard welding method, however, instead that is done by a simple welding of stacked-up plates. Also, the stacked-up type heat exchanger for a gas boiler according to the present invention has an improved thermal efficiency beyond the conventional one. Therefore, the size of a heat exchanger can be reduced and further the manufacturing cost is curtailed.

BRIEF DESCRIPTION OF THE DRAWINGS

The present invention will now be clarified by way of embodiments with reference to the accompanying drawings in which.

DESCRIPTION OF THE PREFERRED EMBODIMENT

Figure 1:
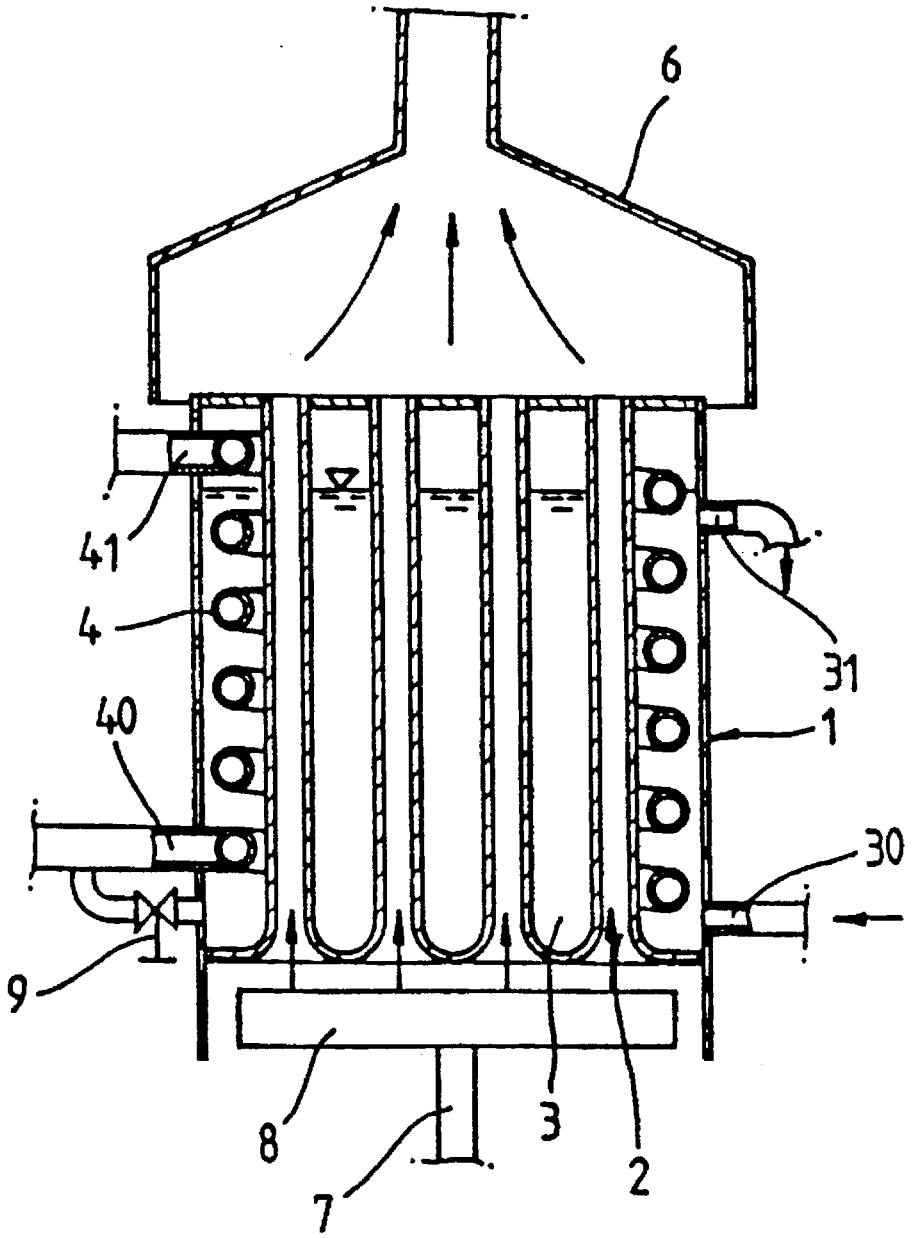
FIG. 1 is a sectional view for showing a heat exchanger of the conventional hot-water storage type gas boiler.
Figure 2:
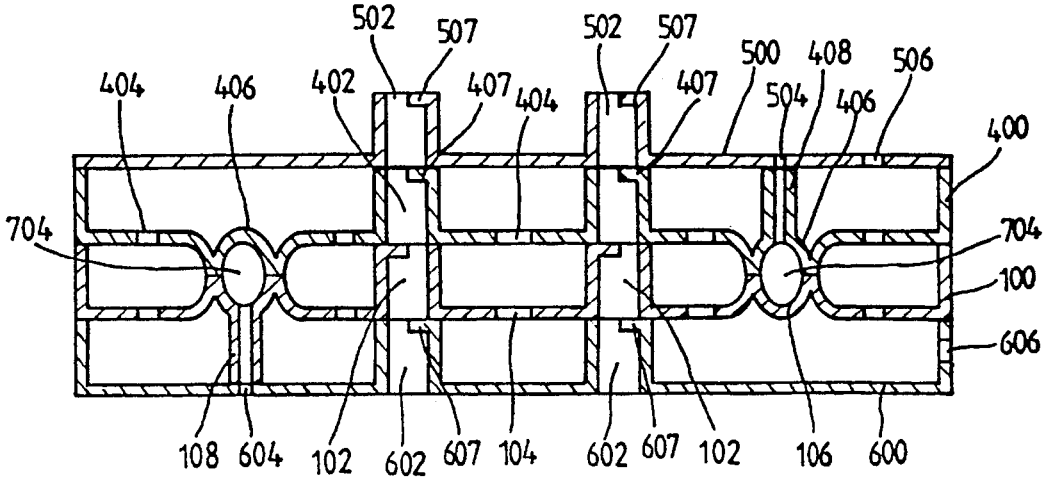
FIG. 2 is a center-line sectional view for showing an embodiment of the heat exchanger for a gas boiler according to the present invention.

FIG. 2 is a cross sectional view along the center-line of the heat exchanger for a gas boiler according to the present invention. As shown in FIG. 2, the heat exchanger for a gas boiler according to the present invention is composed of a plurality of plates stacked up one over another. Hereunder, each of the plates will be described in detail from the bottom to top portion.

A bottom plate 600 has a plurality of combustion gas flues 602 passing through from bottom to top. At the end of each of combustion gas flues 602 a baffle 607 is provided for partially blocking the opening hole of combustion gas flue 602. On bottom plate 600 a cold-water inlet 604 is provided while forming a through hole. At the periphery of bottom plate 600 a circumferential bent jaw with the same height as combustion gas flue 602 is provided. At a part of the circumferential jaw a return heating-water outlet 606 is provided by making a through hole.

A first plate 100 has a combustion gas flue 102 with the same form of combustion gas flue 602 of bottom plate 600 provided at an area corresponding to combustion gas flue 602 of the bottom plate 600. At an area corresponding to cold-water inlet 604, a cold-water supply pipe 108 protruding from first plate 100 toward bottom plate 600 is provided. Cold-water supply pipe 108 is connected to a lower part of a curved portion 106 formed by first plate 100. Curved portion 106 is formed in the shape of a annular around combustion gas flue 102 with the center of the axis of a heat exchanger. At the center of first plate 100, at the bottom surface between combustion gas flue 102 and curved portion, and at the bottom surface between curved portion 106 and the circumferential jaw, a plurality of heating-water inlets 104 are provided throughout from bottom to top.

A fourth plate 400 is similar to first plate 100 in basic structure, however, the upper and lower surfaces thereof are inversed in a 180-degree arc and the direction in which combustion gas flue 402 protrudes is opposite to first plate 100.

A top plate 500 includes a combustion gas flue 502 in the identical shape of combustion gas flues 102, 402 and 602 of bottom plate 600, first plate 100 and fourth plate 400. At an area corresponding to hot-water delivery pipe 408 of fourth plate 400 a hot-water outlet 504 is provided. At a part of top plate 500 a return heating-water inlet 506 is disposed.

Figure 3:
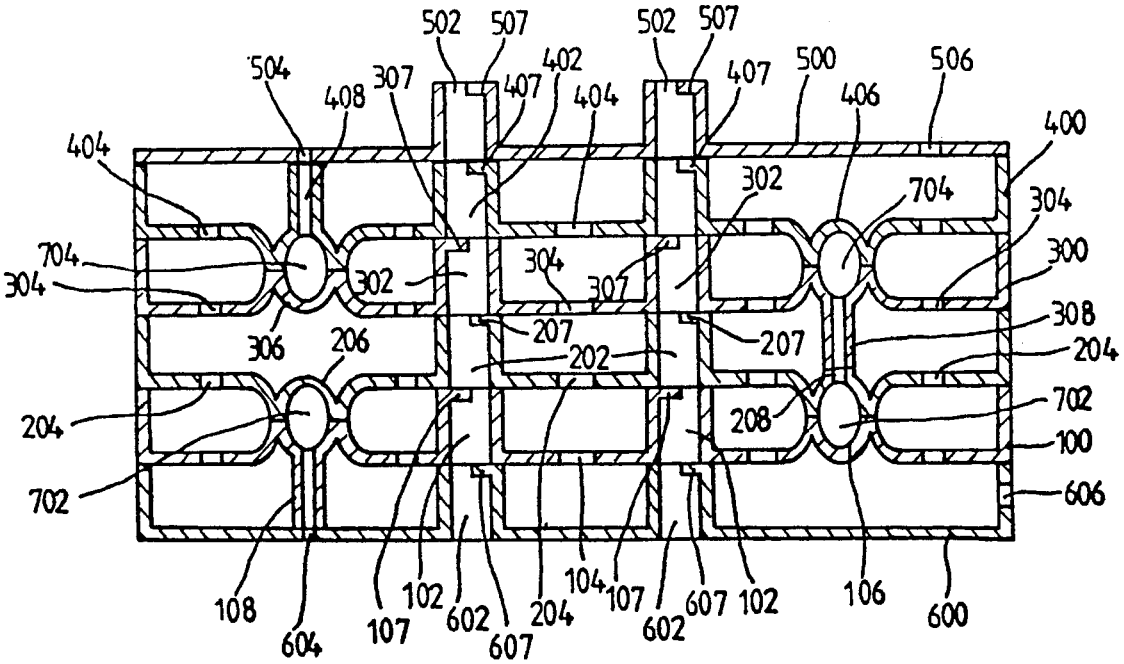
FIG. 3 is a sectional view for showing another embodiment of the heat exchanger for a gas boiler according to the present invention wherein second and third plates are reciprocally stacked up in addition to the first embodiment.

FIG. 3 is a sectional view of a heat exchanger wherein a second plate and a third plate are reciprocally stacked up according to another embodiment of the present invention.

As shown in FIG. 3, the structures of bottom plate 600, first plate 100, fourth plate 400 and top plate 500 are the same as shown in FIG. 2.

A second plate 200 has a combustion gas flue 202 in the same form of combustion gas flue 102 of first plate 100, which second plate 200 is disposed at the corresponding area to combustion gas flue 102 of first plate 100. At an area corresponding to curved portion 106 of first plate 100 a curved portion 206 with the inversed shape of curved portion 106 of first plate 100 is provided. A hot/cold-water flowing tube 702 is formed by fitting curved portion 106 of first plate 100 together with curved portion 206 of second plate 200. At a part of hot/cold-water flowing tube with a maximum distance from cold-water supply pipe 108 of first plate 100, a cold-water discharge outlet 208 is provided while connecting the lower part of curved portion 206 of second plate 200. At a bottom surface of second plate 200 corresponding to heating-water inlet 104, a heating-water inlet 204 with the same shape of heating-water inlet 104 is provided.

A third plate is similar to first plate 100 in basic structure but it is differentiated in that a cold-water supply pipe 308 is situated at the 180-degree opposite side of cold-water supply pipe 108 of first plate 100.

Figure 4:
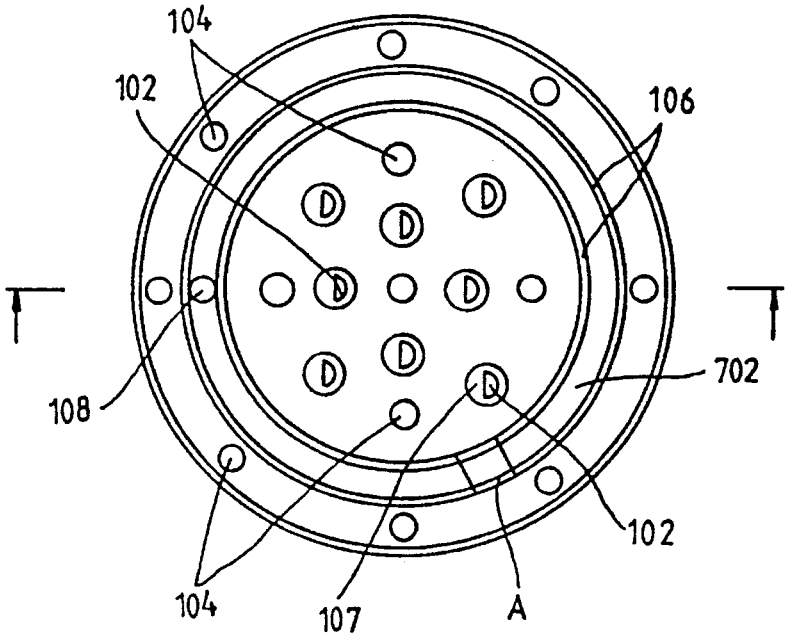
FIG. 4 is a top plan view for showing a first plate shown in FIG. 2.

FIG. 4 is a top plan view of the first plate according to FIG. 2.

As shown in FIG. 4, first plate 100 is formed in the shape of a circle and includes combustion gas flue 102, heating-water inlet 104 and a cold-water supply pipe 108. A total of 8 combustion gas flues 102 are disposed symmentrically around the center of the plate. At each of combustion gas flues 102 baffle 207 is installed. Between combustion gas flues 102 and at the outer area, a total of 13 heating-water inlets 104 are provided. Around combustion gas flues 102 curved portion 106 is provided which finally forms hot/cold-water flowing tube 702. At the lower part of hot/cold-water flowing tube 702 a cold-water supply pipe 108 is provided. At a part of curved portion 106 a flowing hole A which crosses the curved portion 106 is formed.

Figure 5:
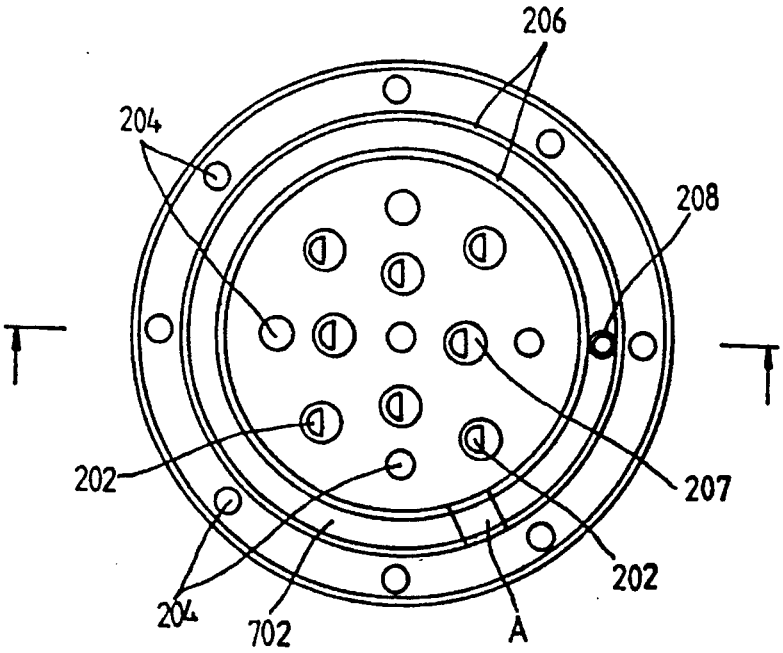
FIG. 5 is a top plan view for showing a second plate shown in FIG. 3.

FIG. 5 is a top plan view of the second plate according to FIG. 3.

As shown in FIG. 5, second plate 200 is formed in the shape of a circle and includes combustion gas flue 202, heating-water inlet 204 and a cold-water supply pipe 208. A total of 8 combustion gas flues 202 are disposed symmetrically around the center of the plate. At each of combustion gas flues 202 baffle 207 is installed. Between combustion gas flues 202 and at the outer area, a total of 13 heating-water inlets 204 are provided. Around combustion gas flues 202 curved portion 206 is provided which finally forms hot/cold-water flowing tube 702. At the lower part of hot/cold-water flowing tube 702 a cold-water supply pipe 208 is provided at the opposite side of cold-water supply pipe 108 of first plate 100. At a part of curved portion 206 a flowing hole A which crosses the curved portion 206 is formed.

Figure 6:
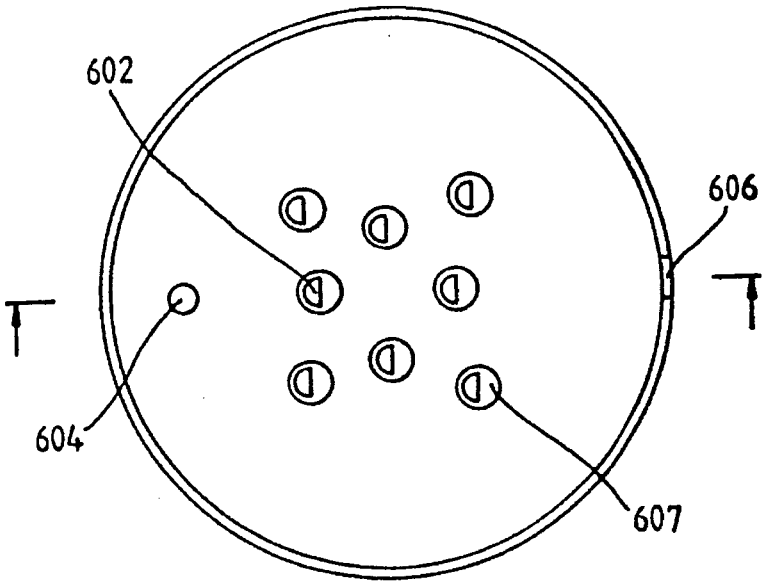
FIG. 6 is a top plan view for showing a bottom plate shown in FIG. 2.

FIG. 6 is a top plan view of the bottom plate according to FIG. 2.

As shown in FIG. 6, bottom plate 600 is formed in the shape of a circle and includes combustion gas flue 602 and cold-water inlet 604. A total of 8 combustion gas flues 602 are disposed symmetrically around the center of the plate.

At each of combustion gas flues 602 baffle 607 is installed. At a part of bottom plate 600 corresponding to the area of cold-water supply pipe 108, cold-water inlet 604 is provided.

Figure 7:
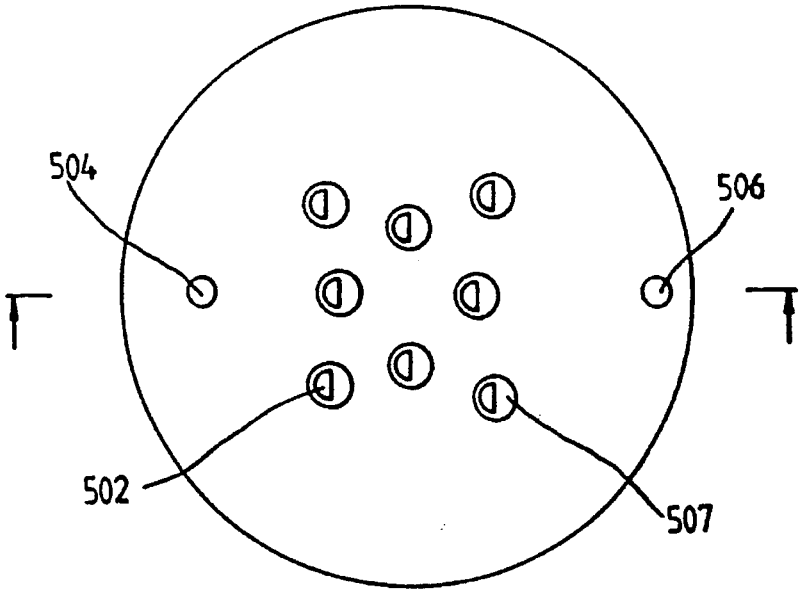
FIG. 7 is a top plan view for showing a top plate shown in FIG. 2.

FIG. 7 is a top plan view of the top plate according to FIG. 2.

As shown in FIG. 7, top plate 500 is formed in the shape of a circle and includes combustion gas flue 502, hot-water outlet 504 and return heating-water inlet 506. A total of 8 combustion gas flues 502 are disposed symmetrically around the center of the plate. At each of combustion gas flues 502 baffle 507 is installed. At an area corresponding to hot-water delivery pipe 408 hot-water outlet 504 is formed. At a part of top plate 500 return heating-water inlet 506 is provided.

Those plates described in the foregoing are readily made by drawing and bending sheet metal by use of press mold. Each of those plates are fitted together by braze welding after being stacked up one over another.

In the heat exchanger for a gas boiler according to the present invention constructed as above, hot-water and heating-water are respectively made through heat exchange with exhaust gas. At this time, hot/cold-water, heating-water and exhaust gas flow through their own passages so they are not mixed nor directly contact one another.

As shown in FIG. 3, the flowing path of the exhaust gas is as follows. High temperature exhaust gas generated by the combustion of gas flows up through combustion gas flue 602 of bottom plate 600. The exhaust gas conflicts with baffle 607 at the end of combustion gas flue 602 and the rising speed thereof is lowered. Thereafter the exhaust gas enters into combustion gas flue 102 of first plate 100. The exhaust gas in combustion gas flue 102 of first plate 100 flows into combustion gas flue 202 of second plate 200 by the same course as that of bottom plate 600. By such a way, exhaust gas passes through the combustion gas flue of each of the plates, reachs the top, and finally goes out of the heat exchanger.

Hot/cold-water for supplying a user with hot-water flows in the following way. Cold-water supplied by cold-water inlet 604 of bottom plate 600 enters into hot/cold-water flowing tube 702 formed between first plate 100 and second plate 200 through cold-water supply pipe 108. The cold-water that has flowed thereinto fills hot/cold-water flowing tube 702 in the shape of a annular and flows up through cold-water supply pipe 308 of third plate 300 via cold-water discharge outlet 208. At this time, the cold-water is warmed by the heat exchange with heating-water therearound. The cold-water which has entered into hot/cold-water flowing tube 704 is delivered to the opposite side hot-water delivery pipe 408 by a similar way in hot/cold-water flowing tube 702. The water that has passed through hot-water delivery pipe 408 finally becomes hot and goes out of a heat exchanger through hot-water outlet 504.

At this time, hot-water outlet 504 is connected with a hot-water pipe (not shown) so hot-water can be delivered to a desired place.

Heating-water flows in the following way. Cold heating-water that has been delivered to a heat exchanger through a heating pipe in a room enters into a heat exchanger through a heating pipe (not shown) connected to return heating-water inlet 506. The heating-water flows into space between top plate 500 and fourth plate 400 and thereafter into space formed between fourth plate 400 and third plate 300 through a plurality of heating-water inlets 404. The heating-water reaches bottom plate 600 through heating-water inlets 304, 204 and 104 formed at each of the plates respectively. The heating-water that has reached bottom plate 600 does not go out until bottom plate 600 is filled up to a certain level since a heating-water inlet is not provided at the bottom of bottom plate 600. The heating-water flowing through the plate is intermixed with other heating-water around flowing hole A provided at the curved portion. The heating-water intermixing is also made in each of the plates in such a manner.

If a boiler with a larger thermal capacity is required, a couple of plates consisting of first plate 100 and second plate 200 or third plate 300 and fourth plate 400 can additionally be inserted between the bottom plate and the top plate. In such a case, the inserted plates are preferably provided in the way that the cold-water supply pipes are reciprocally provided while maintaining a 180-degree arc against the axis of heat exchanger. The inserted plates increase the area of thermal exchange and accordingly the flow of hot/cold-water and heating-water can be facilitated.

Depending upon necessity, the direction of the flow of heating-water can be inversed by changing return heating-water outlet 606 of bottom plate 600 and return heating-water inlet 506 of top plate 500 with each other. Likewise, the direction of the flow of hot/cold-water can be inversed by changing cold-water inlet 604 of bottom plate 600 and hot-water outlet of top plate 500 with each other in terms of their function.

Therefore, according to the stacked-up type heat exchanger for a hot-water storage type gas boiler constructed as above, a hot-water pipe is provided by stacking up and simply welding plates without installing a separate pipe by hard welding. Accordingly, the assembling is easily achieved and the thermal efficiency is improved as well. Thus the size of a heat exchanger can be smaller and the manufacturing cost is effectively reduced.

It should be obvious to people skilled in the art that modifications can be made to the invention as described above without departing from the spirit or the scope of the invention.

What is claimed is:

1. A stacked-up type heat exchanger for a gas boiler comprising a bottom plate, a first plate, a fourth plate and a top plate wherein:

the bottom plate includes one or more combustion gas flue(s) for carrying exhaust gas burned in a burner, a return heating-water outlet for concentrating heating-water and expelling it, and a cold-water inlet for delivering cold-water;

the first plate includes a combustion gas flue communicating with the combustion gas flue of the bottom plate, one or more heating-water inlets for delivering heating-water, annular cavity which faces downward, is concave in cross-section and which forms a ring-type pipe by fitting together with a fourth plate illustrated below, and a cold-water supply pipe, one end of the cold-water supply pipe being connected to the cold-water inlet and the other end of the cold-water supply pipe communicating with a lower part of a curved portion formed by the annular cavity;

the fourth plate includes a combustion gas flue communicating with the combustion gas flue of the first plate, one or more heating-water inlets for carrying heating-water, annular cavity which faces upward, is concave in cross-section and which forms a ring-type pipe by fitting together with the annular cavity of the first plate, a hot-water delivery pipe disposed at an upper part of a curved portion formed by the annular cavity and communicating with a hot/cold-water flowing tube formed by the annular cavity being fitted together with each other; and the top plate includes a combustion gas flue communicating with the combustion gas flue of the fourth plate, a return heating-water inlet for delivering return heating-water into a heat exchanger, and a hot-water outlet connected with the hot-water delivery pipe.

2. The heat exchanger as claimed in claim 1, further comprising a second plate and a third plate reciprocally stacked up between the first plate and the fourth plate, wherein the second plate includes a combustion gas flue communicating with the combustion gas flue of the first plate, one or more heating-water inlets for carrying heating-water, annular cavity which faces upward, is concave in cross-section and which forms a ring-type pipe by fitting together with the annular cavity of the first plate, and a cold-water outlet provided at an upper part of a curved portion formed by the annular cavity and communicating with the hot/cold-water flowing tube; and the third plate having the same structure as the first plate.

3. The heat exchanger as claimed in claim 1 or 2, wherein between the bottom plate and the top plate, two or more combined sets consisting of the first plate, the second plate, the third plate and the fourth plate are stacked up.

4. The heat exchanger as claimed in claim 1 or 2, wherein at an end of each of the combustion gas flues, a baffle for delaying the flow of exhaust gas is provided.

5. The heat exchanger as claimed in claim 3, wherein at an end of each of the combustion gas flues, a baffle for delaying the flow of exhaust gas is provided.

6. The heat exchanger as claimed in claim 1, wherein the return heating-water outlet of the bottom plate serves as a return heating-water inlet, and the return heating-water inlet of the top plate, serves as a return heating-water outlet.

7. The heat exchanger as claimed in claim 1, wherein the cold-water inlet of the bottom plate serves as a hot-water outletlet and the hot-water outlet of the top plate can change its function.

* * * * *